United States Patent [19]

Bourque et al.

[11] Patent Number: 4,773,658

[45] Date of Patent: Sep. 27, 1988

[54] SKATE

[75] Inventors: Rene Bourque, Duvernay; Icaro Olivieri, Westmount, both of Canada

[73] Assignee: Warrington Inc., Lachine, Canada

[21] Appl. No.: 780,886

[22] Filed: Sep. 27, 1985

[30] Foreign Application Priority Data

Oct. 1, 1984 [CA] Canada ..... 464439

[51] Int. Cl.[4] ..... A63C 1/02

[52] U.S. Cl. ..... 280/11.12

[58] Field of Search ..... 280/11.1 R, 11.12, 11.19, 280/11.3, 600; 36/12, 19.5, 106, 115

[56] References Cited

U.S. PATENT DOCUMENTS 3,273,263 9/1966 Klima ..... 36/12

3,934,892 1/1976 Baikie ..... 280/11.12

4,336,948 6/1982 Couture ..... 280/11.12

FOREIGN PATENT DOCUMENTS 3043425 7/1982 Fed. Rep. of Germany ..... 36/115

*Primary Examiner*—John J. Love

*Assistant Examiner*—Richard Camby

*Attorney, Agent, or Firm*—Foley & Lardner, Schwartz, Jeffery, Schwaab, Mack, Blumenthal & Evans

[57] ABSTRACT

A skate comprises a boot and an ice skate blade with fixed molded plastics support. The molded plastics support includes a boot receiving means having the outline of the sole of the boot and having a ridge adapted to be fixed to the base of the boot. The support may be fixed to the boot by way of a suitable adhesive, and the boot receiving portion of the support replaces the sole of the boot.

5 Claims, 2 Drawing Sheets

SKATE

BACKGROUND OF THE INVENTION

1. Field of the Invention

The present invention relates to a runner support for a skate boot, and more particularly to a boot and molded plastic support for an ice skate blade.

2. Description of the Prior Art

Since the introduction of the molded plastic skate blade support, the majority of ice skates being sold today includes such blade supports. Previously, skate blade supports were manufactured out of sheet metal, and the process required skilled labour and considerable time. With molding techniques, the metal blade is merely placed in a mold and the plastic material is injected into the mold, thus anchored to the blade. In some cases, however, the blade is made removable from the molded support. The manner of fixing the blade and blade support to the boot has, however, not changed. Traditionally, a leather or nylon fabric skate boot is formed on a last, a sole is applied, and then the blade support is fixed to the sole by riveting. This latter step is time consuming.

The design of the plastic skate blade support is such as to simulate the metal supports, particularly with respect to the fore and aft platforms adapted to be riveted to the sole and heel portions of the full sole of the finished boot.

In addition to the process of attachment of the blade support to the sole of the boot being time consuming, it has been found that the riveted skate support to the sole of the boot does not transmit completely the driving force applied through the boot by the skater to the blade. Since the support is attached to the sole at spaced-apart riveting points, some of the driving energy is absorbed in the slight separation of the blade support platforms from the sole, either on one side or the other, due to the torsional dimension of the driving forces being transmitted.

SUMMARY OF THE INVENTION

It is an aim of the present invention to provide an improved boot and molded plastic blade support combination which avoids all or most riveting, thus reducing the time required to assemble the skate.

It is a further aim of the present invention to improve the transmission of the driving forces from the skater's foot to the blade by eliminating the tendency of separation between the support platforms and the boot.

It is a further aim of the present invention to eliminate the full sole applied to the skate boot in the case of a last-made boot, and to thus reduce weight and cost, while providing a more efficient skate.

It is understood that the term "skate", as used in this specification, means a combination boot, support and runner, and that the runner may be an ice skate blade, rollers for roller skates, etc.

A construction in accordance with the present invention comprises a runner support made of molded plastics material, comprising an elongated member extending in the longitudinal axis of the support, a runner adapted to be secured to the elongated member, a boot receiving member on said elongated member and having the outline of the full sole of a boot, at least a continuous peripheral portion of the boot receiving member being adapted to contact the base of a skate boot, and means for securing the boot receiving member to the base of a boot.

In a more specific embodiment of the present invention, the runner is in the form of an ice skate blade, while the boot is a last-formed boot having a lower, an insole, and the boot receiving member of the support is adhesively fixed to the boot lower in place of the sole.

It is understood that the so-formed support can be advantageously utilized with a molded plastics skate boot even though the skate boot might itself have an integral sole. It has been a quest of skate manufacturers for some time to provide an integral skate boot and skate support. However, because the rigidity of the plastics material for the boot is different from that required for the blade support, the one-piece skate boot and molded support has been acceptable only in the lower price range of skates.

However, by molding the support and the boot of separate and distinct plastics, the two elements can be joined together by a proper adhesive and provide the advantages of a one-piece integral support and boot.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
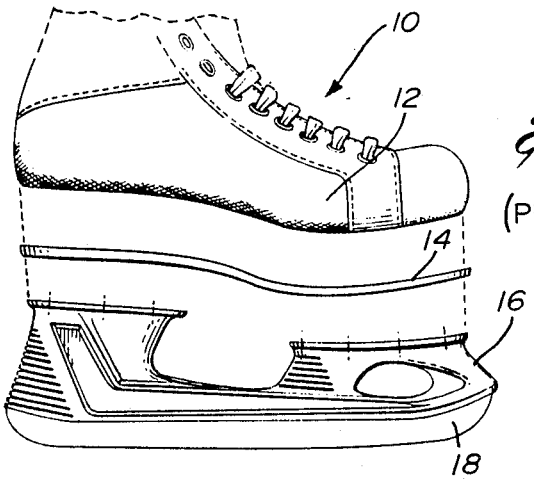
Fig. 1 (PRIOR ART)
FIG. 1 is a side exploded view of the conventional skate showing the skate boot, the sole and the blade support.
Figure 2:
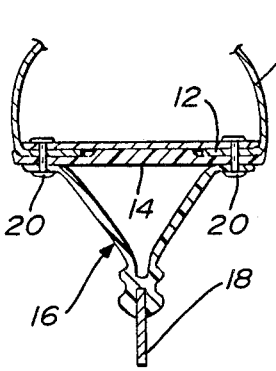
Fig. 2 (PRIOR ART)
FIG. 2 is a cross-sectional view taken transversely of a skate of the type shown in FIG. 1, again illustrating the conventional skate construction.
Figure 3:
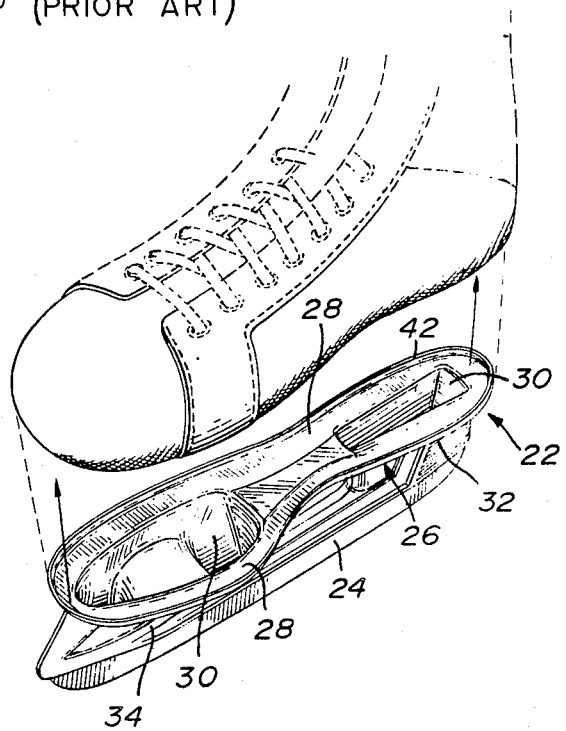
FIG. 3 is an exploded view in perspective of the blade support in accordance with the present invention and a boot.
Figure 4:
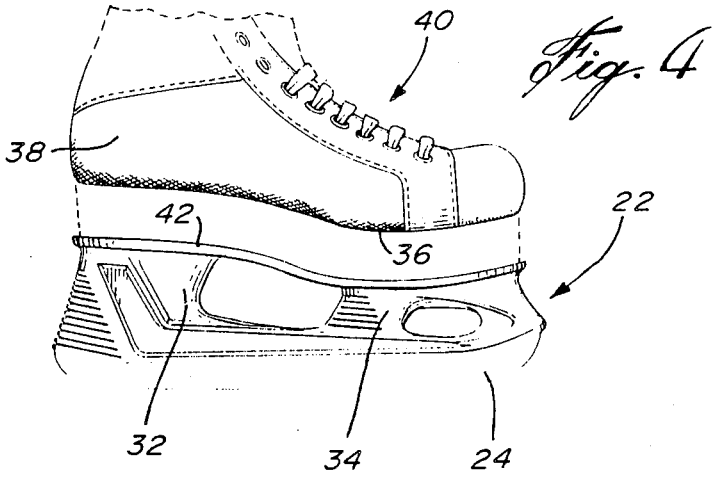
FIG. 4 is a side elevation similar to FIG. 1, but illustrating the present invention.
Figure 5:
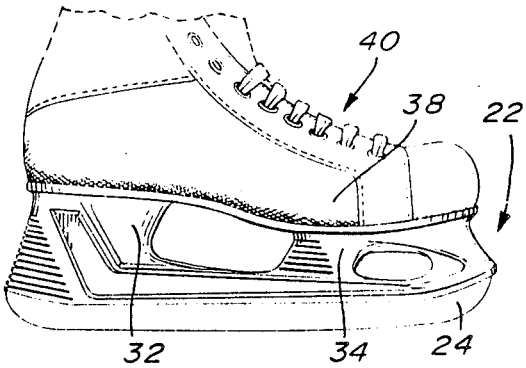
FIG. 5 is a side elevation of the completed skate.
Figure 6:
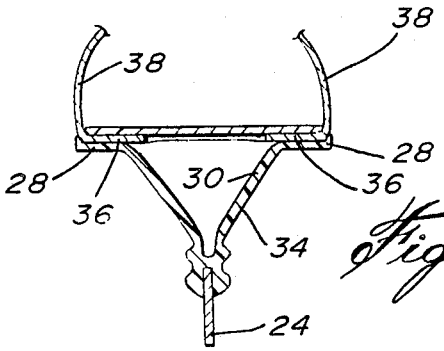
FIG. 6 is a lateral cross-section similar to FIG. 2, but of the skate in accordance with the present invention.

As shown in FIGS. 1 and 2, the conventional skate construction includes a last-formed skate boot 10, including a lower 12 and a sole 14 which is applied to the lower of the boot 10 while still on the last. The molded blade support 16, including a skate blade 18, is attached to the sole 14 by means of rivets 20.

The blade support of the present invention is a one-piece molded item 22 in which is provided a metal blade 24. The support 22 has a boot receiving member 26 which has a full outline of a sole of the boot. A peripheral ridge 28 surrounds the molded cavities forming the hollow pedestals 32 and 34. The peripheral ridge 28 is adapted to conform with the inwardly turned edges 36 of the lower 38 of the boot.

In the present embodiment, an upstanding flange 42 or rim extends around the periphery of the ridge 28. The purpose of the flange is to ensure that no spaces are left after the boot and support are fixed together. The flange 42 acts as a buffer between the two elements being fixed together.

It is contemplated that a suitable adhesive will be used which will be spread along the ridge 28 and would adhere to the inwardly extending portions 36 of the lower 38. It is comtemplated that in certain circumstances, some rivets might be needed which would pass through the ridge 28 through the inwardly extending edges 36 to ensure secure fixing of the support to the boot.

We claim:

1. An ice skate comprising a last formed boot, a blade and a runner support wherein the runner support is made of a one piece molded rigid plastics material and comprises an elongated member extending in the longitudinal axis of the runner support, the blade secured to the elongated member, the runner support including a boot receiving member, the last formed boot having a base having a continuous edge portion and only an insole, the outline of the base being the outline of the sole and heel thereof, said boot receiving member having the outline of the full sole and heel portion of said boot, said boot receiving member comprising only a continuous peripheral support portion contacting the edge of the base of the boot and means for bonding the continuous peripheral support portion of the boot receiving member to the base of the boot.

2. A skate as defined in claim 1 wherein the last-formed boot includes a lower having inwardly extending portions forming the edge of the base, and fixed to the insole, the continuous support portion of the base contacts the inwardly extending portions of the lower, and adhesive means are provided for bonding the continuous support portion of the boot receiving member to the inwardly extending portions of the lower of the boot.

3. A skate as defined in claim 2, wherein the peripheral edge of the boot receiving member is bounded by an upstanding flange.

4. A runner support as defined in claim 1, wherein the runner is in the form of an ice skate blade fixed and anchored in the elongated member of the support and pedestals extend from the elongated member, the pedestals being hollow and opened towards the top of the support, the boot receiving means including a peripheral flange surrounding the cavities of the hollowed-out pedestals.

5. A skate as defined in claim 2, wherein the means for fixing the continuous support of the boot receiving member to the base of the boot is adhesive.

* * * * *